US005730618A

United States Patent [19]

Baker et al.

[11] Patent Number: 5,730,618

[45] Date of Patent: Mar. 24, 1998

[54] PANEL FOR MOUNTING OF ELECTRICAL TERMINALS

[75] Inventors: Daniel L. Baker; John E. Grant, both of Cambridge, Canada

[73] Assignee: AVP Mfg. & Supply Inc., Cambridge, Canada

[21] Appl. No.: 607,989

[22] Filed: Mar. 4, 1996

[51] Int. Cl.[6] ..... H01R 4/24

[52] U.S. Cl. ..... 439/403; 439/733.1; 439/746; 439/404

[58] Field of Search ..... 439/403, 395, 439/397, 405, 404, 408, 746, 417, 418, 78, 733.1

[56] References Cited

U.S. PATENT DOCUMENTS

| | | | |
|---|---|---|---|
| H1 | 12/1985 | Wattana-Chayakul | 439/408 |
| 3,976,350 | 8/1976 | Keglewitsch | 439/404 |
| 4,210,378 | 7/1980 | Baribeau | 439/397 |
| 5,207,587 | 5/1993 | Hamill et al. | 439/403 |

*Primary Examiner*—Gary F. Paumen
*Assistant Examiner*—Tho Dac Ta
*Attorney, Agent, or Firm*—R. Craig Armstrong

[57] ABSTRACT

The panel has several sections, each with a different hole profile. The top panel section has a hole diameter which corresponds to the terminal flange in such a way that the top panel section contacts the terminal flange, holding the terminal with frictional gripping force. This contact keeps the terminal from wobbling, thus eliminating the weakening of the terminal support legs and shorting between terminals. The panel section between the top and rear panel sections (i.e. the middle section) has a hole diameter which corresponds to the outer diameter of the terminal between the terminal flange and the terminal support legs, so that the terminal can be press fitted in the middle section hole. The rear panel section has a hole diameter which is conical or profiled with a larger diameter towards the top panel section, corresponding to the width of the support legs in such a way that the support legs can be fully sprung out, and a smaller diameter towards the rear of the mass termination panel. A modified tool bit, for use in an industry standard impact tool, undercut far enough so that it does not bottom on the terminal, is used for terminating wires on the terminals. The tool stops against the raised top or rear panel surfaces, eliminating the direct hammering on the terminal by the impact tool.

5 Claims, 5 Drawing Sheets

PANEL FOR MOUNTING OF ELECTRICAL TERMINALS

BACKGROUND OF THE INVENTION

1. Field of the Invention

This invention relates generally to mass termination panels or blocks, both of which will be referred to as "panels" hereafter, and more particularly, to a mass termination panel with holes for mounting two-sided, split cylinder terminals for standard hook-up type wire as well as for 110 ohm digital audio wire, whether stranded or solid wires are used. The wires can be terminated, i.e. be attached and electrically connected to the ends of the terminals, using an impact tool or other suitable means for forcing the wire into the split of the cylinder.

To ensure that the terminal is held sufficiently in the panel hole, one form of conventional mass termination panel using split cylinder terminals relies on a plastic module which houses the terminal. The plastic module/terminator assembly is inserted together into the panel hole. To maintain terminal density and leave room on the panel for wire dressing, the terminal is made relatively small to make room for the modules on the board. The smaller terminal size can reliably terminate standard wires 22–26 AWG (American Wire Gauge) only, without unwanted deformation of the terminal.

In the following text the top of the mass termination panel or block is defined as being the side from which a terminal is inserted in the panel and the rear of the mass termination panel or block is defined as being the opposite side to the top side.

2. Description of the Prior Art

U.S. Pat. No. 4,662,699 (Vachhani et al.), discloses a mass termination panel using a split cylinder terminal, which can be terminated using an impact tool. A two-sided split cylinder terminal is used, housed in a plastic module which is then inserted into a metal panel. To obtain a higher terminal density and leave room on the panel for wire dressing, the terminal is made relatively small to make room for the plastic modules on the board. The smaller terminal size limits the wire termination to 22–26 AWG, standard wire only. The terminal relies on the strength of its support legs for all of its panel retention when being terminated from the rear of the panel. The plastic module holds the terminal essentially rigid within the plastic module itself, ensuring an equal pressure on both support legs during wire termination. The impact tool has enough clearance not to use the terminal as a stop, so the tool tip impacts first against the wire and stops at the plastic module. There is a problem with this mass termination panel, however, when terminating the larger wire sizes according to the terminal specification, in particular 22 AWG wire, because of the higher pressures exerted on the terminator. This wire often pushes the terminal through the panel when terminating from the rear, necessitating major repair inside an equipment rack with cabling interfering with the access to the terminals and panels. A further problem with this mass termination panel is that the plastic module fits loosely into the metal panel, making tool alignment from the rear of the panel a semi-skilled job. Any misalignment increases the risk of either terminal push-through or the wire not seating properly in the terminal.

U.S. Pat. No. 4,682,412 (Pfeifer), discloses a wire insertion tool comprising an impactor for impacting an insertion tip which inserts and terminates insulated wires into terminal connectors.

A two-sided split cylinder terminal (sold under the AMP trademark), as described in the prior art FIG. 1, is already known. This terminal 1 terminates 18–28 AWG insulated standard hook-up wire 2, stranded or solid. It also terminates 110 ohm digital audio wire which typically has a thicker insulation than standard wire. This wire is 22–26 AWG (stranded or solid). This terminal is typically mounted in a mass termination panel board 3 which is 3/32 inch thick, the terminal being held between the flange 4 and the terminal support legs 5. The terminal is specified for hand termination using a special hand tool. The terminal accepts impact termination, but only from the front of the panel. Using an impact tool, with the tip from a cut off hand tool, can cause problems with terminal distortion because the tool has to bottom on the terminal in order to set the wire to specified depth in the terminal. When using an impact tool for terminating from the rear of the panel the terminal can significantly deform from the tool striking the terminal, the terminal support legs can weaken and collapse after repeated termination, (typically at any time from the first to perhaps the 50th strike), and the terminal can then be pushed out of the panel. The weakening support legs can cause immediate terminal wobble increasing the possibility of the terminal shorting against adjacent terminals.

SUMMARY OF THE INVENTION

It is an object of the invention to provide a mass termination panel or block which will allow the use of the existing two-sided split cylinder terminal (AMP) when using an impact termination tool for termination from the back of the mass termination panel or block, without the weakening and collapse of the terminal support legs.

A further object of the invention is to provide a mass termination panel or block where the terminal is prevented from being deformed by the tool striking the terminal.

A still further object of the invention is to provide a mass termination panel or block with a terminal density which is 0.200" vertically and 0.300" horizontally, terminal center to terminal center. This leaves enough clearance between vertical rows of terminals to dress wires, i.e. to route and bundle them in an ordered manner away from the terminals.

In the invention, non-conductive panel materials were chosen. The panel comprises a terminal mounting board which, in turn, comprises several sections, each with a different hole profile. The top panel section has a hole diameter which corresponds to the terminal flange in such a way that the top panel section contacts the terminal flange, holding the terminal with frictional gripping force. This contact keeps the terminal from wobbling, thus eliminating the weakening of the terminal support legs and shorting between terminals. The panel section between the top and rear panel sections (i.e. the middle section) has a hole diameter which corresponds to the outer diameter of the terminal between the terminal flange and the terminal support legs, so that the terminal can be press fitted in the middle section hole. The rear panel section has a hole diameter which is conical or profiled with a larger diameter towards the top panel section, corresponding to the width of the support legs in such a way that the support legs can be fully sprung out, and a smaller diameter towards the rear of the mass termination panel. A modified tool bit, for use in an industry standard impact tool, undercut far enough so that it does not bottom on the terminal, is used for terminating wires on terminals mounted in a mass termination panel or block according to the invention. The tool stops against the raised top or rear panel surfaces, eliminating the direct hammering on the terminal by the impact tool. The thickness of the front and rear panels is chosen so that, in combination with the slot depth in the impact tool bit, the terminated wires will seat in the exact specified positions (manufacturer's specifications).

The rear panel hole diameter, towards the outer rear surface of the rear panel, is such that enough clearance is left between the outer wall of the terminal and the panel hole surface to allow an extraction tool to enter the hole and compress the support legs, so that the terminal can be removed by pushing or pulling it out towards the top of the mass termination panel or block.

The absolute rigidity of the mass termination panel or block is increased with a panel or block according to the invention, making precise clean wire terminations possible. This panel design allows the use of this terminal design in high performance applications, also when frequent rewiring is required.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
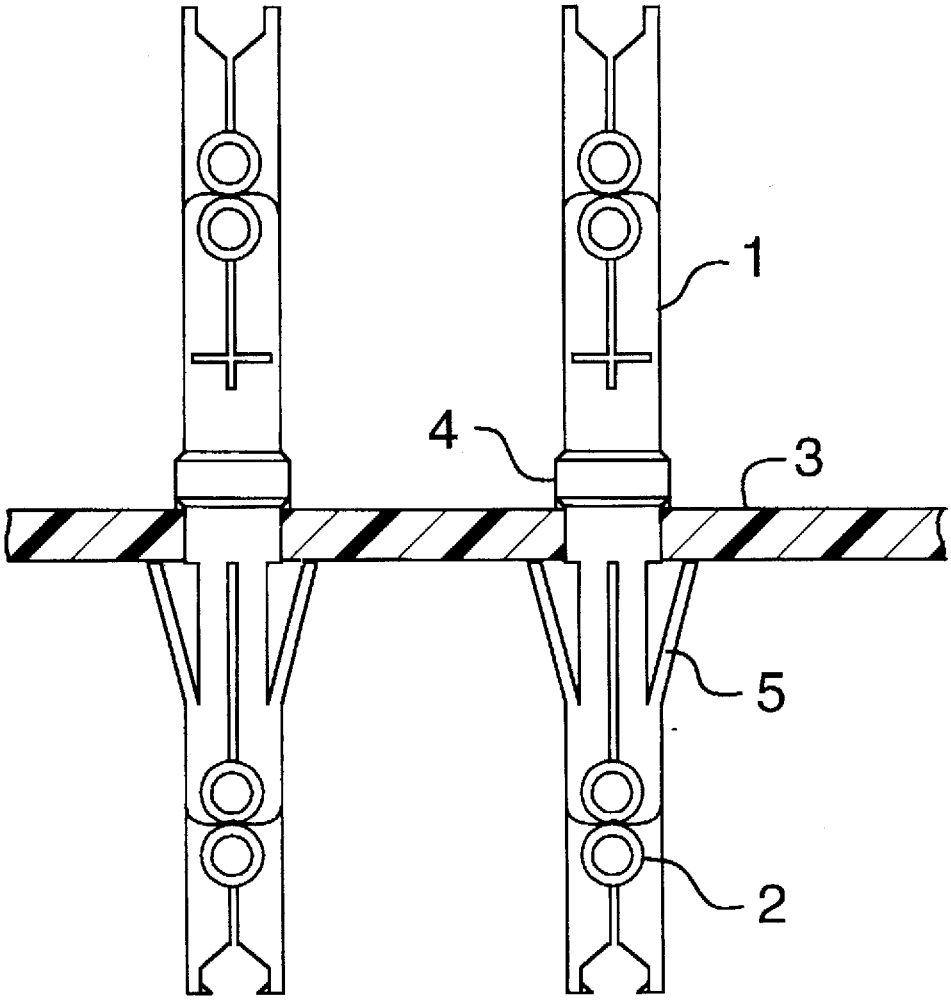
FIG.1 (PRIOR ART)
FIG. 1 is a side view of a terminal mounting board according to the prior art.

FIG. 1 shows a two-sided split cylinder terminal 1 (AMP) according to the prior art, having a flange 4 and support legs 5. The terminal is specified to be mounted in a board 3 of 3/32" thickness, the board mounting hole gripping the terminal between the flange and the support legs.

Figure 2:
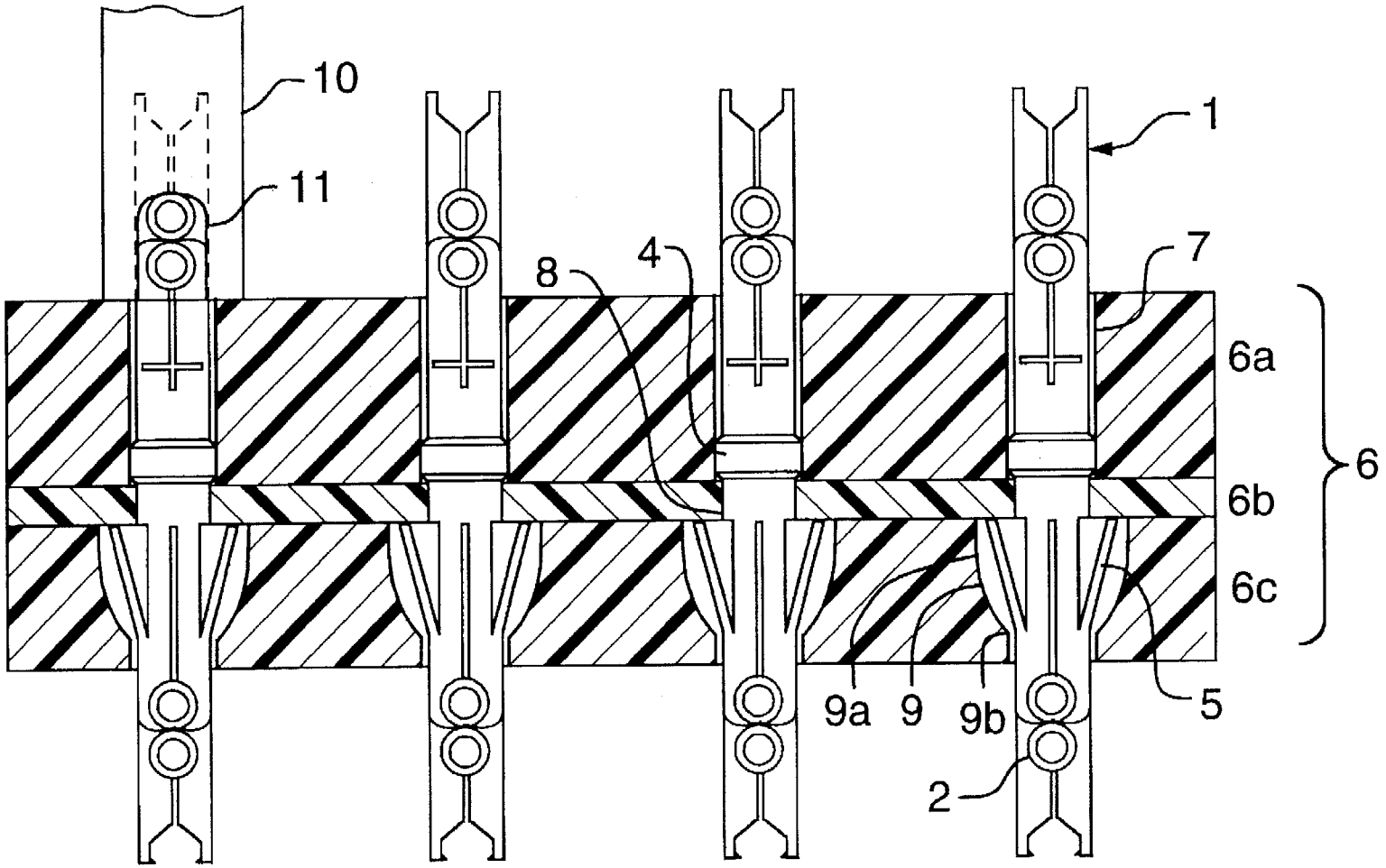
FIG. 2 is a side view of a mass termination panel according to one embodiment of the invention.
Figure 3E:
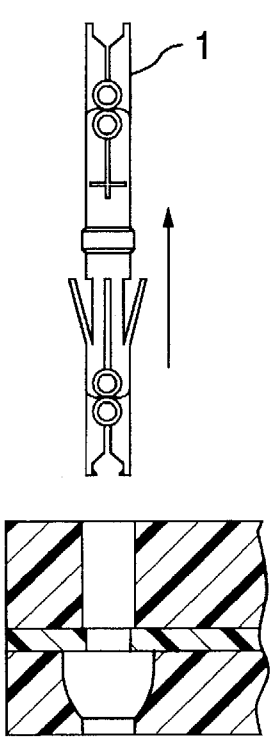
FIGS. 3*a*–3*e* show a device for removing terminals from a panel according to one embodiment of the invention, and the sequence of steps in doing so.
Figure 3D:
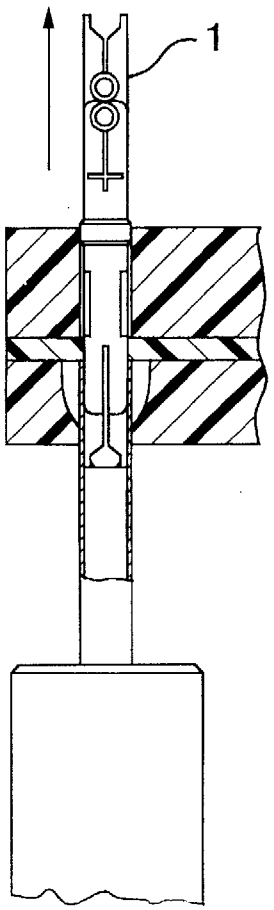
Figure 3C:
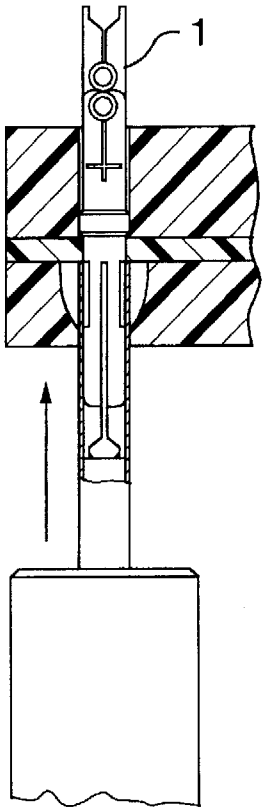
Figure 3B:
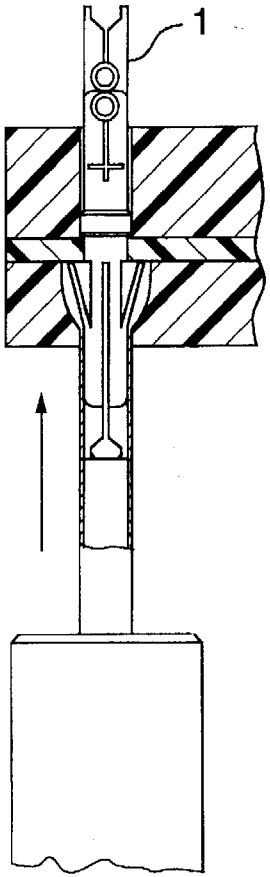
Figure 3A:
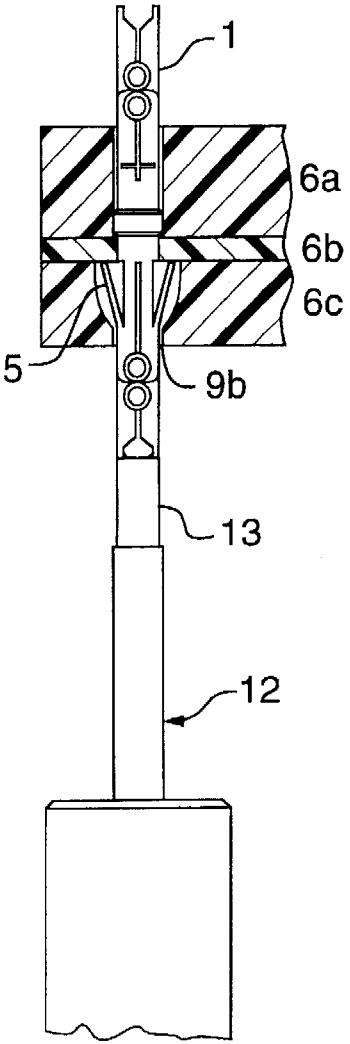

FIG. 2 shows a terminal mounting board 6 comprising several sections (6*a*, 6*b* and 6*c*). The top panel section 6*a* has a first hole 7, which diameter corresponds to the terminal flange 4 in such a way that the top panel section contacts the terminal flange holding the terminal with frictional gripping force. This contact keeps the terminal from wobbling, thus eliminating the weakening of the terminal support legs and shorting between terminals. The middle panel section 6*b*, located between the top 6*a* and rear 6*c* panel sections, has a second hole 8, which diameter corresponds to the outer diameter of the terminal 1 between the terminal flange 4 and the terminal support legs 5, so that the terminal can be press fitted in the middle section hole. The rear panel section 6*c* has a third hole 9, which is conical or profiled with a larger diameter part 9*a* towards the top panel section 6*a*, corresponding to the width of the support legs 5 in such a way that the support legs can be fully sprung out, and a smaller diameter part 9*b* towards the rear of the panel section 6*c*.

FIG. 2 further shows a tool bit 10, for use in an industry standard impact tool, undercut far enough so that it does not bottom on the terminal 1 when used for terminating wires 2 on terminals mounted in a mass termination panel or block according to the invention. The tool bit 10 stops against the raised top 6*a* or rear 6*c* panel surfaces, eliminating the direct hammering on the terminal by the impact tool. The thickness of the front 6*a* and rear 6*c* panels is chosen so that, in combination with the slot 11 depth in the impact tool bit 10, the terminated wires 2 will seat in the exact specified positions (manufacturer's specifications).

FIG. 3 shows a device for removing terminals from a panel according to one embodiment of the invention. The rear panel hole 9*b* diameter, towards the outer rear surface of the rear panel 6*c*, is such that enough clearance is left between the outer wall of the terminal 1 and the panel hole surface to allow a tubular extraction tool 12 to enter the hole and compress the support legs 5, so that the terminal 1 can be removed towards the top of the mass termination panel or block, either by pushing with the plunger 13 or by pulling from the top of the mass termination panel or block with e.g. a pair of pliers.

Figure 4:
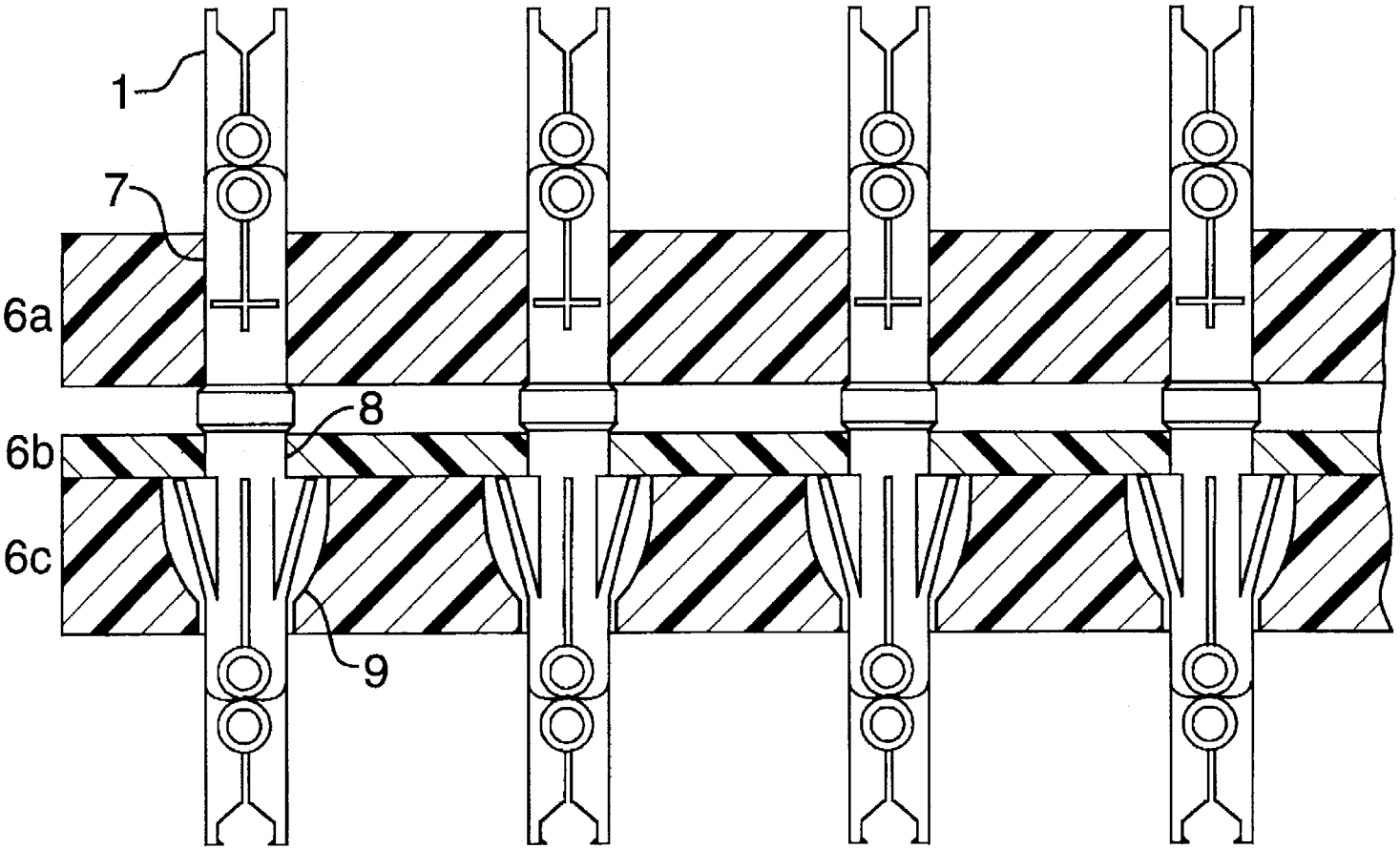
FIG. 4 is a side view of a mass termination panel according to another embodiment of the invention.

Another embodiment of the invention is described in FIG. 4, where the rear 6*c* and middle 6*b* panel sections are separated from the top panel section 6*a*. The terminal 1 is mounted in the middle and rear panel sections, and the top panel section is then pressed down on top of all mounted terminals. The first hole 7 has a diameter which is smaller than the outer diameter of the terminal flange 4. The second hole 8 and third hole 9 have the same specifications as in FIG. 2. The top panel section 6*a* has to be removed before any terminal 1 can be removed. The top panel is securely held in place by any known fastening means such as bolts or screws, using washers to set it at the appropriate gap.

Figure 5:
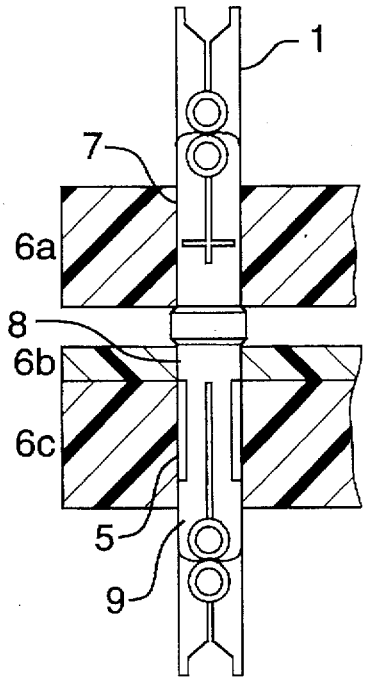
FIG. 5 is a side view of a mass termination panel according to still another embodiment of the invention.

Still another embodiment of the invention is described in FIG. 5, where the third hole 9 has the same diameter as first hole 7 and second hole 8, i.e. having a diameter which corresponds to the outer diameter of the terminal 1 between the terminal flange 4 and the terminal support legs 5. The terminal support legs are not required to spring out in this embodiment; but stay compressed in the hole. A variation of this embodiment only has two board sections (i.e. no separate middle panel section 6*b*).

Figure 6:
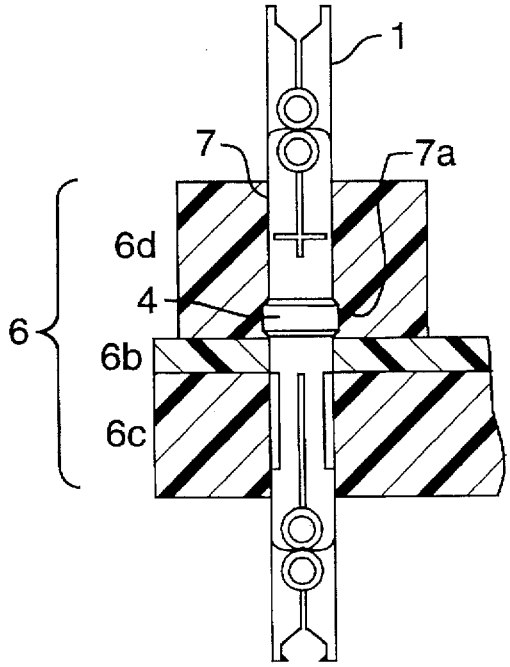
FIG. 6 is a side view of a mass termination panel according to yet another embodiment of the invention.

Yet another embodiment of the invention is described in FIG. 6, where the top of the mounting board 6 comprises several smaller locking strips 6*d* which have holes 7 with diameters smaller than the outer diameter of the terminal flange 4 and an enlarged hole portion 7*a* which diameter corresponds to the terminal flange 4. The locking strips are removably mounted on to the middle board 6*b* using any required fastening means, such as screws, quick clips etc. The locking strips can be designed to secure any required number of terminals. A variation of this embodiment only has two board sections (i.e. no separate middle panel section 6*b*).

The absolute rigidity of the mass termination panel or block is increased with a panel or block according to the invention, making precise clean wire terminations possible. This panel design allows the use of an existing terminal design in high performance applications, also when frequent rewiring is required.

In the invention, non-conductive panel materials were chosen.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the different terminal mounting board sections can be screwed, bolted, fused or glued together. The board material can be chosen freely as long as it fulfills such obvious criteria as having sufficient strength, being non-conductive, etc.

What is claimed as the invention is:

1. A mass termination panel for mounting of terminals, said terminals having a generally cylindrical body, an annular flange extending radially outwardly from said body, support legs extending at an acute angle from said body, and slots for receiving wires, said mass termination panel comprising three parallel boards, namely a central board and first and second outer boards, having substantially co-axial holes therethrough, said terminals being mountable in said holes with said annular flanges abutting against a first surface of said central board and with free end of said support legs abutting against a second surface of said central board, wherein said holes in said first outer board have a diameter corresponding to the outer diameter of said annular flange, located to contact said annular flange around its outer circumference, and wherein said holes in said second outer board have a portion with a diameter large enough to accommodate said support legs.

2. A mass termination panel according to claim 1, in which said boards are made from an insulating material.

3. A mass termination panel according to claim 1, wherein said boards are of such a thickness that, with said terminal mounted in said panel, front and rear surfaces of said panel will serve as stops for a tip of an impact termination tool when said tool is used to terminate wires on said terminal.

4. A mass termination panel as recited in claim 1, where said holes in said second outer board each have said portion with a diameter large enough to accommodate said support legs, and a smaller diameter portion remote from said central board.

5. A mass termination panel according to claim 4, wherein said hole portion with a diameter large enough to accommodate said support legs has a curved conical shape.

* * * * *